US006884307B1

(12) United States Patent
Hofmann et al.

(10) Patent No.: US 6,884,307 B1
(45) Date of Patent: Apr. 26, 2005

(54) INSENSITIVE EXPLOSIVE MOLDING POWDER, PASTE PROCESS

(75) Inventors: Heinz Hofmann, Schnaittach (DE); Karl Rudolf, Schrobenhausen (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 16 days.

(21) Appl. No.: 10/672,384

(22) Filed: Sep. 26, 2003

Related U.S. Application Data

(63) Continuation-in-part of application No. 10/253,036, filed on Sep. 24, 2002, now abandoned.

(30) Foreign Application Priority Data

Apr. 12, 2002 (DE) ..... 102 16 399

(51) Int. Cl.[7] ..... C06B 25/34; D03D 23/00
(52) U.S. Cl. ..... 149/92; 149/109.6
(58) Field of Search ..... 149/92, 109.6, 149/19.92

(56) References Cited

U.S. PATENT DOCUMENTS

| | | | |
|---|---|---|---|
| 5,067,996 | A | 11/1991 | Lundstrom et al. |
| 5,316,600 | A | 5/1994 | Chan et al. |
| 5,458,706 | A | 10/1995 | Finck et al. |
| 5,547,526 | A | 8/1996 | Wanninger et al. |
| 5,565,150 | A | 10/1996 | Dillehay et al. |
| 5,567,912 | A | 10/1996 | Manning et al. |
| 5,750,921 | A | 5/1998 | Chan et al. |
| 5,932,835 | A | 8/1999 | Woodall et al. |
| 6,217,799 | B1 | 4/2001 | Lee et al. |
| 6,485,587 | B1 | 11/2002 | Han et al. |

FOREIGN PATENT DOCUMENTS

| | | | |
|---|---|---|---|
| DE | 38 04 397 | C1 | 9/1989 |
| DE | 3804397 | C1 | 9/1989 |
| DE | 43 24 739 | C1 | 9/1994 |
| DE | 19719073 | A1 | 11/1998 |
| EP | 0036481 | | 2/1981 |
| EP | 0254850 | A2 | 4/1987 |
| EP | 0 816 307 | B1 | 1/1998 |
| EP | 1312595 | A1 | 11/2002 |

OTHER PUBLICATIONS

Chemical Abstract No. 225928h, L.J. Montesi, et al. Development of the High Performance Metal Accelerating Explosive vol. 125, No. 18 Oct. 26, 1996, Columbus, OH.

Chemical Abstract No. 339057c. Hyoun–Soo, et al. "Characteristics of the insensitive Pressed Plastic Bonded Explosive, DXD–59", vol. 131, No. 25, Dec. 20, 1999, Columbus, OH.

*Primary Examiner*—Aileen Felton
(74) *Attorney, Agent, or Firm*—Scully, Scott, Murphy & Presser

(57) ABSTRACT

Insensitive explosive molding powders are provided that include an explosive component, a binder and a plasticizer. The insensitive molding powders include explosive crystals that are bound by a binder system. Moreover, the insensitive high explosive molding powder of the present invention has a bi-/tri-/tetramodal grain composition comprising coarse grain (280–360 $\mu$m with an upper limit of 500–700 $\mu$m) and fine grain (e.g., 35–45 $\mu$m) explosive crystals that a bonded by a binder system comprising a plasticizer and a binder. The molding powder of the present invention is coated in waterless solvent process having a solvent content of less than 0.01 wt. % and is immediately ready for pellet pressing.

19 Claims, No Drawings

INSENSITIVE EXPLOSIVE MOLDING POWDER, PASTE PROCESS

RELATED APPLICATIONS

This application is a continuation-in-part (CIP) application of U.S. Ser. No. 10/253,036, filed Sep. 24, 2002 now abandoned, the entire content of which is incorporated herein by reference.

FIELD OF THE INVENTION

The present invention relates to improved insensitive explosive molding powders, and more particular to a process for preparing improved insensitive explosive molding powders using RDX (known variously as cyclonite, cyclotrimethylenetrinitramine and 1,3,5-trinitro-1,3,5-triazacyclooctane) or HMX (known variously as cyclotetramethylenetetranitramine, and 1,3,5,7-tetranitro-1,3,5,7-tetraazacyclooctane) quality B crystals that are subjected to a crystal surface treatment, separation of RDX and HMX crystals and coating in a waterless solvent process. Additionally, specific pressure forces are minimized therefore providing explosive pellets that achieve nearly a 100% theoretical maximum density (t.m.d.) without the need of heavy hardening pressing tools.

BACKGROUND OF THE INVENTION

Usually water slurry methods have been used for producing explosive molding powders showing sensitive or insensitive characteristics depending on the type of binder employed in regard to the requirements of STANAG 4170 or MIL Std 2105 b. The testing procedures for sufficient insensitivity of explosives to meet "Insensitive Munition" status are described, for example, in U.S. Pat. No. 5,547,526.

The insensitivity of an explosive pellet depends on the quality of the high explosive (HE)-crystals, binder type and weight percent present in the pellet, densities close to 100% t.m.d. and the perfect coating on each crystal.

In U.S. Pat. Nos. 5,067,996 and 5,547,526, the influence of the flexibility of the binder on the insensitivity is shown. However, neither the castable HMX mixture of the '996 patent with 15 wt. %–18 wt. % binder, nor the pressable HMX mixture of the '526 patent with 5 wt. % binder fulfill today's requirement of non-rupture (i.e., maximum sustained burning of the explosive) of the encasement described in the '526 patent during fast cook off.

Only the U.S. Navy qualified PBXN 9 explosive molding powder described in U.S. Pat. No. 6,485,587 with a binder content of about 8 wt. % meets the insensitive requirements. The PBXN 7 mixture of the '587 patent is not considered because of its very high content of already insensitive, but low energy, 1,3,5-triamino-2,4,6-trinitrobenzene (TATB). The other explosive mixtures provided in the '587 patent are still in development as indicated by PBX "W". The binder employed in the '587 patent consists of HYTEMP®, a polyacrylic elastomer, and di(2-ethylhexyl)-adipate (DOA).

Achievement of a very high t.m.d at minimized pressing forces, which provides explosive pellets that have minimized porosities as well as being substantially crack free, require the use of harmonic crystal classes having mean diameters in the ratio of 1:1/7:1/49:1/343 (approximately, for bimodal use, the first two ratios are used, while for trimodal use, the first three ratios are employed and for tetramodal use, all four ratios are used) and crystal class mass ratios of 70:30 at bimodal, 65:28:7 at trimodal, and 64:27:7:3 at tetramodal (these are rough values, depending on the crystal batches used).

The modality influences the characteristics of the explosive pellets and offers proper choice needed for specific munition types. Grain classes and weight ratios disclosed in the '587 patent, for example, are driven by the total crystal surface depended behavior of the binder system HYTEMP® 4454, a polyacrylic elastomer, and DOA and finally require, relative to the present invention, 50% to 100% higher pressing forces to approach a necessary high t.m.d. for an insensitive explosive and usually fail to achieve this insensitivity goal at binder contents lower than 6 wt. %.

Indicated by the modalities above, crystal class C with a mean diameter are usually chosen as coarse grains; however, there is a need to consider the significantly increased possibility of internal crystal failures, e.g., hot spots of large crystals, due to today's crystallization methods.

Another insensitivity influencing point for consideration is that if water is present or it elevated temperatures are used, the contents of the pellets tend to vaporize. A water content of 0.01%, for example, potentially produces a waterdamp volume of approximately 30% of the pellet volume, thus increasing small pores to critical hot spot pores at munition cook off.

SUMMARY OF THE INVENTION

The present invention provides a general method of producing batches of a family of insensitive explosive molding powders. The method of the present invention comprises the steps of:

- preparing a lacquer comprising one or more organic solvents, a binder and a plasticizer;
- adding the lacquer and an explosive component, such as RDX, HMX or others, to a multiple finger or high shear mixing kettle;
- heating the kettle to a temperature from about 35° C. to about 40° C., while mixing at moderate agitation speeds such as, for example, in a DRAIS multiple finger mixer at 20 rpm for about 30 minutes; and
- removing the organic solvents by evacuation at a constant temperature of the ingredients of the kettle according to vaporization temperatures of the solvents, and at a rate that avoids boiling of the solvent.

In accordance with one embodiment of the present invention, the agitation time is about 3 hours, but may vary depending on the type of solvent employed. At a kettle pressure of about 2 mbar, the agitation speed is increased to 40 rpm until all the moisture content is evacuated and a desired agglomeration is achieved. The time for this procedure is about 20 minutes depending on the modality of grain distributions, ratio of binder to plasticizer and ratio of binder system to crystal mass.

The method of the present invention provides an explosive molding powder that is ready for use after cooling down to ambient room temperatures. After the molding powder has been cooled, the powder can be formed into pellets having a predetermined diameter by using sufficient specific pressing pressures. For example, pellets having a diameter of about 22 mm can be made using a specific pressing pressure of about 0.9 kbars. The pressing pressure decreases to 0.55 kbars for pellets having a diameter of about 100 mm. Other pellet diameters ranging from 2 mm to 150 mm can also be formed using the explosive molding powder of the present invention. In some embodiments of the present invention, the die and explosive mixture is evacuated to pressure less than 1 mbar. Thus, pellets can be crushed and peeled mechanically out of the casings and can be simply recycled by mechanical granulation without any losses of the pressability and insensitivity characteristics.

DETAILED DESCRIPTION OF THE INVENTION

As stated above, the present invention provides a method of producing insensitive high explosive molding powders that comprise an explosive component, a binder and a plasticizer. The insensitive molding powders of the present invention comprise explosive crystals that are bound by a binder system. Moreover, the insensitive high explosive molding powder of the present invention has a bi-/tri/tetramodal grain composition comprising coarse grain (280–360 μm with an upper limit of 500–700 μm) and fine grain (35–45 μm and 6–8 μm for trimodal, and 1 μm for tetramodal) explosive crystals that a bonded by a binder system comprising a plasticizer and a binder. The molding powder of the present invention is coated by a waterless solvent process having a solvent content of less than 0.01 wt. % and is immediately ready for pellet pressing.

Illustrative examples of explosive components that can be used in the present invention include but are not limited to: RDX, HMX and other like explosive materials. Combinations of the explosive components are also contemplated in the present invention. Preferred explosive components are RDX and HMX.

The plasticizers, which form part of the binder system of the present invention, include, but are not limited to: polymer plasticizers such as acyclic dicarboxylic acid esters, and phthalates. Examples of acyclic dicarboxylic acid esters include, but are not limited to: esters of adipic acid such as DOA, and diisodecyladipate (DIDA). Illustrative examples of phthalates that can be employed in the present invention include, but are not limited to: di-2-ethylhexylphthalate (DOP), diisononylphthalate (DINP) and diisodecylphthalate (DIDP).

The binder employed in the present invention is a polyacrylic elastomer such as for example, HYTEMP® sold by Zeon Chemical L.P., 4100 Bells Lane, Louisville, Ky. 40211. Other polymeric elastomers are also contemplated herein.

The present invention can be used to manufacture and repair, if necessary, or rework any explosive formulation from crystals made by traditional quality B or A of improved quality explosive material specifications, with a binder to plasticizer ratio between 4 to 8 wt. %, preferably 4 to 6 wt. %. The binder to plasticizer ratio may be varied between 1:0.8 to 1:3 wt. % ratio relative to the desired mechanical characteristics of the explosive pellets.

Illustrative examples of preferred organic solvents that can be used in the method of the present invention include, but are not limited to: ethyl acetate, dimethyl ketone (i.e., acetone), ethyl methyl ketone, methyl propyl ketone or a proper mixture thereof. The ratio of solvents to binder employed in the present invention is the range of 3–10 times the mass of the binder process.

The method of the present invention provides explosive molding powders in which the residual moisture is far below 0.01% wt.

In some embodiments of the present invention, the insensitive molding powder includes coarse grains that have a mean grain size of about 300 to about 360 μm with an upper limit of 500 to 700 μm. In this embodiment, the fine grains follow the harmonic rules of highest possible crystal grains packaging.

In other embodiments of the present invention, the insensitive high explosive molding powder in which the fine high explosive grain sizes from tri- or tetramodal distribution are substituted with up to 2 wt. % of a filler, such as AEROSIL (i.e., a fumed silica).

The following explosives powders, which were made using the method of the present invention, will now be described.

EXAMPLE 1

HMX, quality B mixture with 8% of binder system near the insensitivity limited in accordance with TL (=TL 1376-0800)

bimodal grain composition coarse grain mean grain size 300–360 μm fine grains 15 μm solvent for binder system HYTEMP® (a polyacrylic elastomer) and DOA in a quantitative ratio of 1:3 acetone 3–10 times the mass of the binder system pressing pressure for the explosive mixture with a tool of 50 mm diameter was 1.5 kbars.

Result: Non-initiation≦31 kbars, fast cook off/bullet impact; Reaction type V.

EXAMPLE 2

HMX, quality B mixture with 8% of binder system with a marked distance in relation to the insensitivity limit in accordance with the above-mentioned TL.

As in example 1, with the following differences:

coarse grain mean grain size 300–360 μm fine grain mean grain size 3045 μm solvent mixture: ethyl acetate/acetone/ethanol in a ratio of 20%/20%/60% pressing pressure with a tool diameter of 50 mm was 1.0 kbars.

Result: Non-initiation≦31 kbars, fast cook off/bullet impact; Reaction type V.

EXAMPLE 3

HMX, quality B mixture with 4% of binder system at the insensitivity limit in accordance with the above-mentioned TL.

As in example 2, with the following differences:

coarse grain mean grain size 300–340 μm, crystals<500 μm solvent mixture: ethyl acetate/acetone in a ratio of 50%/50% pressing pressure with a tool diameter of 50 mm was 0.95 kbars.

Result: Non-initiation≦26 kbars, fast cook off/bullet impact; Reaction type V.

EXAMPLE 3.1

Less Sensitive, Near STANAG 4170.

octogen mixture with 8% binder system

As in example 3, with the following differences:

pressuring pressure 0.65 kbars–0.70 kbars with a tool diameter of 110 mm pressing pressure of 0.75 kbars with a tool diameter of 50 mm Result: Non-initiation≦46 kbars, fast cook off/bullet impact; Reaction type V.

EXAMPLE 4

RDX quality B mixture with 8% of binder with a distance relation to the insensitivity limit in accordance with TL bimodal grain composition as example 3 coarse grain<700 μm tool diameter 50 mm required specific pressing pressure, 0.75 kbars with a tool diameter of 110 mm, specific pressing pressure of 0.65–0.7 kbars Result: Non-initiation≦26 kbars, fast cook off/bullet impact; Reaction type V.

The choice of the bimodal grain size distribution and composition of the solvent for the production of the binder lacquer HYTEMP®, a polyacrylic elastomer, and DOA, as well as a differing proportion of the solvent mixture in the lacquer result in explosive mixtures which are of a different insensitivity and which in the GAP-/Fast Cook/off/Bullet impact test reach the classification of less sensitivity in accordance with STANAG 4170 and, with specific pressing pressures—in dependence on caliber—of only 0.6–0.9 kbars, reaching more than 99% of the t.m.d.

Furthermore, using harmonic tri- or tetramodal grain distributions in the above mentioned mixtures or substitution of finer explosive grains from tri- or tetramodal grain distributions by up to 2% wt. AEROSIL do no change the insensitivity status or the superior pressability, but provide harder pellets preferably for use in high rotating gun projectiles.

While the present invention has been particularly shown and described with respect to preferred embodiments, it will be understood by those skilled in the art that the foregoing and other changes in forms and details may be made without departing from the spirit and scope of the present invention. It is therefore intended that the present invention not be limited to the exact forms and details described and illustrates, but fall within the scope of the appended claims.

What is claimed is:

1. An insensitive high explosive molding powder comprising an explosive component bound by a binder system, wherein said explosive component comprises coarse-grain and fine-grain explosive crystals comprising a bimodal, trimodal or tetramodal grain composition;

said binder system comprises a binder and a plasticizer; and said powder is coated in a waterless solvent process having a solvent content of less than 0.01 wt %.

2. The insensitive high explosive molding powder of claim 1 wherein the coarse-grain explosive crystals have a mean grain size of 300–360 μm with an upper limit of 500–700 μm and the fine-grain explosive crystals vary between 35–45 μm and 6–8 μm for trimodal, and 1 μm for tetramodal.

3. The insensitive high explosive molding powder of claim 1 wherein the fine-grain explosive crystals from tri- and tetramodal distribution are substituted with up to 2 weight % fumed silica.

4. The insensitive high explosive molding powder of claim 1 wherein the binder and plasticizer are present in a ratio of 1:0.8 to 1:3.

5. The insensitive high explosive molding powder of claim 1 wherein the explosive crystals comprise RDX, HMX or a mixture thereof.

6. The insensitive high explosive molding powder of claim 1 wherein the plasticizer is an acyclic dicarboxylic acid ester, or a phthalate.

7. The insensitive high explosive molding powder of claim 6 wherein the plasticizer is an acyclic dicarboxylic acid ester selected from the group consisting of an ester of adipic acid and diisodecyladipate (DIDA).

8. The insensitive high explosive molding powder of claim 7 wherein the ester of adipic acid is di(2-ethylhexyl)-adipate.

9. The insensitive high explosive molding powder of claim 6 wherein the plasticizer is a phthalate selected from the group consisting of di-2-ethylhexylphthalate (DOP), diisononylphthalate (DINP) and diisodecylphthalate (DIDP).

10. A pressed insensitive high explosive pellet comprising the insensitive high explosive molding powder of claim 1.

11. The pressed insensitive high explosive pellet of claim 10 having a diameter of about 2 to about 150 mm.

12. The pressed insensitive high explosive pellet of claim 10 having a diameter of about 20 mm or about 100 mm.

13. A method of forming an insensitive explosive molding powder comprising:

preparing a lacquer comprising one or more organic solvents, a binder and a plasticizer;

adding the lacquer and an explosive component to a mixing kettle;

heating the kettle to a temperature from about 35° C. to about 40° C., while mixing at moderate agitation speeds; and removing the organic solvents by evacuation at a constant temperature of the ingredients of the kettle according to vaporization temperatures of the solvents, and at a rate that avoids boiling of the solvent.

14. The method of claim 13 wherein the explosive component is RDX, HMX or a mixture thereof.

15. The method of claim 13 wherein the plasticizer is an acyclic dicarboxylic acid ester, or a phthalate.

16. The method of claim 15 wherein the plasticizer is an acyclic dicarboxylic acid ester selected from the group consisting of an ester of adipic acid and diisodecyladipate (DIDA).

17. The method of claim 16 wherein the ester of adipic acid is di(2-ethylhexyl)-adipate.

18. The method of claim 15 wherein the plasticizer is a phthalate selected from the group consisting of di-2-ethylhexylphthalate (DOP), diisononylphthalate (DINP) and diisodecylphthalate (DIDP).

19. The method of claim 13 further comprising a pressing step.

* * * * *